US005562079A

United States Patent [19]

Gray, Jr.

[11] Patent Number: 5,562,079

[45] Date of Patent: Oct. 8, 1996

[54] LOW-TEMPERATURE, NEAR-ADIABATIC ENGINE

[75] Inventor: Charles L. Gray, Jr., Pinckney, Mich.

[73] Assignee: The United States of America as Represented by the Administrator of the U.S. Environmental Protection Agency, Washington, D.C.

[21] Appl. No.: 392,491

[22] Filed: Feb. 23, 1995

[51] Int. Cl.[6] ..... F02F 3/00

[52] U.S. Cl. ..... 123/276

[58] Field of Search ..... 123/276, 193.6, 123/668, 669, 670, 258

[56] References Cited

U.S. PATENT DOCUMENTS

| | | | |
|---|---|---|---|
| 4,522,172 | 6/1985 | Oshima et al. | 123/276 |
| 4,667,630 | 5/1987 | Sasaki | 123/276 |
| 4,800,853 | 1/1989 | Kraus et al. | 123/668 |
| 4,864,987 | 9/1989 | Kawamura | 123/668 |
| 4,911,109 | 3/1990 | Kawamura et al. | 123/668 |
| 4,921,734 | 5/1990 | Thorpe et al. | 123/668 |
| 4,998,517 | 3/1991 | Kawamura | 123/668 |
| 5,025,765 | 6/1991 | Kawamura | 123/254 |
| 5,033,427 | 6/1991 | Kawamura et al. | 123/668 |
| 5,329,902 | 7/1994 | Sakamoto et al. | 123/276 |

*Primary Examiner*—Raymond A. Nelli
*Attorney, Agent, or Firm*—Lorusso & Loud

[57] ABSTRACT

A novel, internal combustion engine includes a cylinder, a head closing one end of the cylinder and a piston slidably mounted in the cylinder for reciprocating motion, in the usual manner, which reciprocation is converted into rotary motion by, for example, a conventional crankshaft. The top surface of the piston, cylinder head and cylinder serve as walls defining a system chamber, with a pocket formed in one of the system chamber walls for receiving fuel and serving as a combustion chamber for localized combustion therein. In one disclosed embodiment, the cylinder is divided into two sections with thermal insulation, serving as a heat barrier, disposed between the two sections and the piston has a hollow interior containing one or more heat shields spanning the hollow interior. The method of operation involves injection of fuel into a restricted area within the chamber defined between the piston head, cylinder head and cylinder, e.g., the aforementioned pocket. Air and/or exhaust gas within the chamber surrounding the restricted area of localized combustion serves as thermal insulation, protecting the cylinder walls. Operation is suitably with a peak gas temperature of 900°–1100° C. and a peak gas pressure of 500–1000 psi. Air is introduced in an amount providing 4–5 times the stoichiometric amount of oxygen.

22 Claims, 4 Drawing Sheets

LOW-TEMPERATURE, NEAR-ADIABATIC ENGINE

BACKGROUND OF THE INVENTION

1. Field of the Invention

A novel internal combustion engine which operates at low temperature with high fuel energy utilization efficiency.

2. The Prior Art

The growing utilization of automobiles greatly adds to the presence in the atmosphere of various pollutants including greenhouse gases such as carbon dioxide, which circumstances have led to a quest for approaches to improve the efficiency of fuel utilization for automotive powertrains.

Conventional internal combustion engines (ICE's) used in passenger vehicles average about 15% thermal efficiency in urban driving and have peak efficiencies of about 35%. Even at peak efficiency, current engines discard almost two thirds of the heat energy supplied to them, i.e. through the engine coolant system and through the exhaust gas. The chemical energy contained in fuel is converted into heat energy when it is burned in an engine. Since this combustion takes place in a closed volume (the combustion chamber of the engine), the increased temperature of the combustion gases (and in some cases the increased number of moles of the combustion gases as compared to the reactants) results in an increase in pressure of the system. As the volume of the combustion chamber expands, e.g. the piston moves, work is performed. Conventional internal combustion engines waste much of the available heat energy. First, the combustion chamber is cooled by liquid or air, thus reducing pressure and the potential for work. Second, the expansion process does not allow for full expansion or for full utilization of the pressure developed in the combustion chamber, as the expansion ratio is usually limited by the compression ratio. Third, a considerable amount of heat remains in the exhaust gas.

SUMMARY OF THE INVENTION

Accordingly, it is an object of the present invention to provide an ICE having a significantly increased fuel efficiency capacity. The design of the present invention has the potential for a 50 to 100% improvement.

Another object of the present invention is to provide an ICE which inherently provides for a substantial reduction in the formation of $NO_x$ emissions.

Yet another object of the present invention is to provide an ICE with reduced heat loss by reducing the peak gas temperature of the combustion system.

Still another object of the present invention is to provide an ICE in which an air-concentrated zone of gas is provided in an inner combustion chamber which is physically separated from an air-deficient zone within the remainder of the space between the cylinder head and the piston, the air-deficient zone forming an insulating "outer ring" around the inner combustion chamber, thereby allowing for a good combustion while increasing overall system mass and further reducing system temperature and heat loss.

Still another object of the present invention is to provide a larger expansion ratio than compression ratio in an ICE.

Finally, it is an object of the present invention to provide an ICE and operation of same at near adiabatic conditions.

Accordingly, in furtherance of the foregoing objectives, the present invention provides an ICE with super dilution of the fuel charge with air to provide for near adiabatic operation. More specifically, the present invention provides an internal combustion engine (ICE) including a cylinder, a head closing one end of the cylinder and a piston slidably mounted in the cylinder for reciprocating motion between top dead center and bottom dead center positions. The piston, cylinder and cylinder head define therein an interior chamber. Combustion is isolated within an area of the interior chamber by provision of a pocket centrally located within either the head or the top of the piston, which pocket receives fuel and air for localized combustion therein. The piston is connected to a crankshaft through a piston rod in the conventional manner for converting the reciprocating motion of the piston into a rotary output. Valves are provided in the cylinder head for introduction of combustion air into the system chamber and for exhausting products of combustion therefrom. A conventional fuel injector is mounted in the head for directing fuel into the localized combustion chamber defined by the combustion pocket.

The general reference to "air" used herein is intended to include both air and a mixture of atmospheric air and recirculated exhaust gas. Further, the reference to "stoichiometric amount of oxygen" as used herein is intended include both atmospheric air and an equivalent mass of atmospheric air and recirculated exhaust gas.

In the embodiments employing a piston head of such size that side forces on the piston become a factor, guide means can be interposed between the piston head and the crankshaft, e.g. the combination of a secondary piston and piston cylinder as in the first embodiment described in the following.

The cylinder can be divided into two sections with thermal insulation provided therebetween to form a thermal barrier. With such a thermal barrier oil lubrication can be provided at the lower portion of the piston skirt in a position where, with the piston at top dead center, the oil rings are separated from the combustion chamber by the thermal barrier.

In certain preferred embodiments the piston is of a hollow construction with heat shields contained therein, spanning the hollow interior.

The present invention also provides a method for conducting combustion at near adiabatic conditions within a localized combustion chamber in communication with a larger system chamber defined between the upper surface of a piston, a piston cylinder and cylinder head. Air is introduced into the combustion chamber along with injected fuel for localized combustion, with air in the system chamber surrounding the combustion chamber serving to thermally insulate the cylinder from the combustion chamber. The products of combustion are exhausted from the combustion chamber and system chamber through one or more valves in the usual manner.

In the preferred embodiments, air is introduced into the combustion chamber in an amount typically providing four to five times the stoichiometric amount of oxygen. Combustion is effected at a lower than conventional temperature, i.e. with a peak, average gas temperature preferably within the range of 900°–1100° C. In the preferred embodiments the peak pressure within the combustion chamber will typically be 500–1000 psi.

DESCRIPTION OF THE PREFERRED EMBODIMENTS

Figure 1:
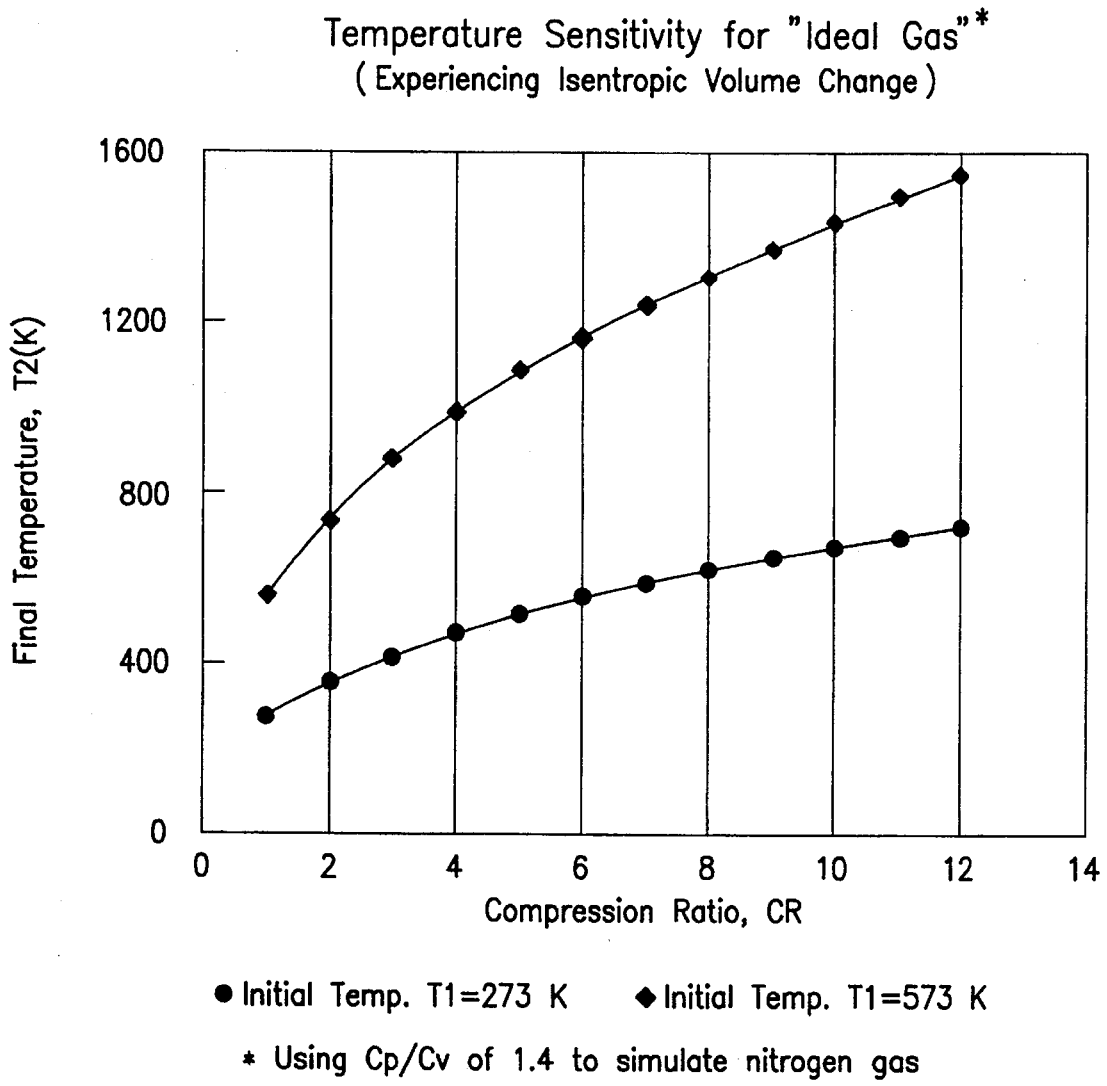
FIG. 1 is a graph of compression ratio versus temperature for an "ideal" gas.

The optimum means of transforming the chemical energy contained in a fuel into mechanical work with a "heat" engine is to maximize the pressure times volume change of the system. In a practical context, fuel is burned in air, increasing the temperature of the combustion gases, and the resulting increased pressure acts on a surface of a given area which moves and thus performs work. The volume change of the system is increased by increasing the expansion ratio of the system. Generally, and when possible, the maximum pressure would be obtained by maximizing the temperature of the system (combustion products plus nitrogen). For a given system, maximum temperature is achieved by minimizing the heat loss from the system. The efficiency of a conventional internal combustion engine would be relatively high except for the significant heat that is lost to the surroundings, because of the extremely high combustion temperature. Extremely high temperatures are also difficult in practice, because of material limitations.

To maximize the thermal efficiency (i.e., rate of work, $\omega$, per rate of fuel energy used) of a hypothetical heat engine: (1) the rate of heat loss to the surroundings, q, must be minimized, (2) the exhaust temperature and pressure ($T_2$, $P_2$) must be as near ambient temperature and pressure ($T_1$, $P_2$) as possible, and (3) the rate of exhaust gas mass, m, discharged must be as low as possible considering the power required of the engine. Minimizing the exhaust gas temperature and pressure can be viewed as two separate processes, with heat loss to be minimized in both.

The embodiments of the invention described below provide novel means to minimize heat loss and, in some cases, provide novel means to minimize exhaust gas pressure as well. Minimizing heat loss will result in higher system pressure after a given expansion ratio and therefore more benefit from greater expansion.

The rate of heat loss to the surroundings, q, is determined by the following equation.

$$q=K\times A\times \Delta T$$

where

K=overall heat transfer coefficient (units of energy transferred per surface area and temperature difference in a unit of time), e.g., $BTU/ft^2\times{}^0F\times hr$.

A=heat transfer surface area $\Delta T$=temperature difference between system gases and ambient surroundings It is obvious that reducing the heat transfer coefficient by insulating the combustion and expansion chambers (or not cooling these surfaces as in current practice) would reduce heat loss. However, the increased temperatures that would result (in excess of 2000° C.) would exceed the minimum strength temperature threshold (and indeed the melting point) of conventional combustion chamber materials. For example, the maximum temperature of workable metal alloys is generally less than 800° C.

Reducing the heat transfer surface area is desirable, but is constrained based on the volume needed for the combustion and expansion chambers. Minimizing the surface to volume ratio is directionally beneficial. However, the present invention does not reduce area, in fact, it will increase the volume (and therefore heat transfer area), e.g., volume by a factor of 5 (5×) and area by a factor of about 3 (3×), for a given power level compared to conventional engines.

In the present invention the peak (as well as the average) temperature of the system gases is reduced to reduce the temperature gradient or "driving force" for heat loss. In this regard the present invention runs contrary to conventional practice which seeks to maximize peak temperature to further the goals of: (1) reducing heat loss (i.e., approaching an adiabatic engine) because it is generally concluded that reducing heat loss must result in increased temperature, and (2) achieving high thermal efficiency because it is generally concluded that high temperature means high efficiency.

It is well known that conventional heat engines which absorb a quantity of heat and reach some maximum temperature, $T_{max}$, and exhaust the "waste" heat at some lower temperature, $T_{low}$, can convert only a fraction of the absorbed heat into work. This even applies to an "ideal engine" (as defined by a certain process) operating under "ideal conditions." The Carnot cycle is often used to show that even with the "ideal engine" only a fraction of the absorbed heat can be converted into work and that this fraction is determined by the operating temperatures, $T_{max}$ and $T_{low}$, and is totally independent of the nature of the engine that operates in comparison to this cycle. The Carnot cycle yields the maximum work that can be derived from a quantity of heat absorbed at one temperature and given out at another, lower temperature. The work done in a Carnot cycle is equal to total heat absorbed at the higher temperature minus the heat given up to the surroundings at the lower temperature. The thermodynamic efficiency is simply this work divided by the total heat absorbed. The thermodynamic efficiency of the Carnot cycle for an ideal gas is equal to $T_{max}$ minus $T_{low}$ divided by $T_{max}$. It is important to stress that it is the closed system nature of the Carnot cycle analysis of the ideal gas, "ideal engine" which yields the direct dependence of cycle efficiency on $T_{max}$. While it is true that "there can be no engine more efficient than a Carnot engine," there has never been a Carnot engine with a $T_{max}$ actually operating at 2000° C. It is therefore not surprising that current practice strives to raise the peak temperature of the system gases to increase thermal efficiency, and this is desirable if the higher temperature in a non-ideal (i.e., real) system does not lead to an even higher percentage of heat loss. For perspective of the embodiment of the invention to be described it should be noted that the Carnot cycle provides that three of the four cycle steps involve no heat loss, with the initial expansion step providing isothermal expansion (i.e., heat input). Only the initial compression step gives up heat to the surroundings. As previously noted, current or conventional engines loose most of their thermal efficiency potential through heat loss during combustion and expansion, while the Carnot cycle allows heat loss in neither.

Thus, the present invention provides a novel approach to reducing heat loss and increasing efficiency by reducing peak combustion temperature. Reducing peak temperature (1) reduces heat loss directly by reducing the temperature driving force (temperature differential between peak gas temperature and cylinder temperature) and (2) reduces heat loss indirectly by allowing the use of materials and engine configurations that can be insulated, thereby achieving near-adiabatic designs. The peak gas temperature in the present invention may advantageously be in the range of 900°–1100° C.

Assuming an adiabatic system comprised of known gases, the temperature rise upon the absorption of a given quantity of heat (e.g., the fuel combustion energy) is directly related to the moles of each gas present and their molar heat capacities. Therefore, reducing the peak temperature in the method of this invention requires an increase in the mass of the gases for a given quantity of heat absorbed. For methods that reduce peak temperature by increasing system mass for a given quantity of heat absorbed and/or by utilizing a lower compression ratio, the mechanical embodiment of the concept must have a larger volume at the point of heat release (i.e., larger combustion chamber) to provide the equivalent power output of a conventional engine operating with high compression ratio and little or no charge dilution. Thus, in the present invention "super dilution" of the fuel charge is achieved by introducing air into the combustion chamber (and optionally waste gas), inducted in a conventional manner through a conventional intake manifold, preferably in an amount giving a value $\lambda$=4–5, wherein A represents the amount of air which contains a stoichiometric amount of oxygen. Accordingly, the ICE of the present invention will utilize a piston having 2–3× the diameter of a piston in a conventional ICE having the same power and the combustion chamber (with the piston at bottom dead center) will have a volume 4–6× that in a conventional ICE.

The peak temperature is also directly affected by the beginning system temperature. Therefore, not heating (or cooling) the incoming charge (e.g. mass of air and fuel) will also minimize the peak temperature. The peak temperature is also directly affected by the compression ratio of the incoming charge, the larger the compression ratio, the higher the peak temperature since work has been done on the incoming charge.

The ICE of the present invention is intended to operate with a peak gas pressure of 500–1000 psi as compared to a peak gas pressure of 1500–2000 psi in a conventional ICE.

FIG. 1 shows the temperature response to compression ratio (factor of volume reduction, CR) and initial temperature for an "ideal gas" volume change that occurs adiabatically and reversibly, but uses the ratio of heat capacity at constant pressure (i.e., the rate of change of enthalphy with temperature at constant pressure) to that at constant volume (i.e., the rate of change of internal energy with temperature at constant volume), Cp/Cv, of 1.40 to simulate nitrogen gas. The general form of the equation that relates the final temperature $T_2$, to the initial temperature, $T_1$, is:

$$T_2 = \frac{T_1}{CR\left(\frac{1}{CR}\right)^{\frac{Cp}{Cv}}}$$

The method of increasing the system mass, for a given quantity of heat absorbed, to reduce the peak temperature will be illustrated with the combustion of methanol. The combustion of one gram mole of liquid methanol at 25° C. produces about 173,670 calories of heat energy. The stoichiometric combustion of one mole of methanol in "simplified air" is illustrated by the following equation:

$$CH_3OH(l) + \frac{3}{2}\ O_2(g) + 6N_2(g) \rightarrow CO_2(g) + 2H_2O(l) + 6N_2(g)$$

Adjusting for physical state and assuming a constant volume, adiabatic system, about 151,740 calories are available to heat the gaseous "combustion products" from 25° C. (assuming combustion at this temperature) to some higher temperature. This peak temperature can be approximated by the following calculation:

$$[Cv(CO_2)+2Cv(H_2O)+6Cv(N_2)]\Delta T=151{,}740$$

where Cv is the average heat capacity over the temperature range in calories per ° C, per gram mole. Using approximate heat capacities yields:

$$[11.05+2(7.86)+6(5.5)]\Delta T=151{,}740$$

and $$\Delta T=2539°\ C.$$

With the initial charge diluted to 50% with "recycled" exhaust products all at the same temperature, ΔT=1269° C., and with 75% dilution, ΔT=635° C.

Figure 2:
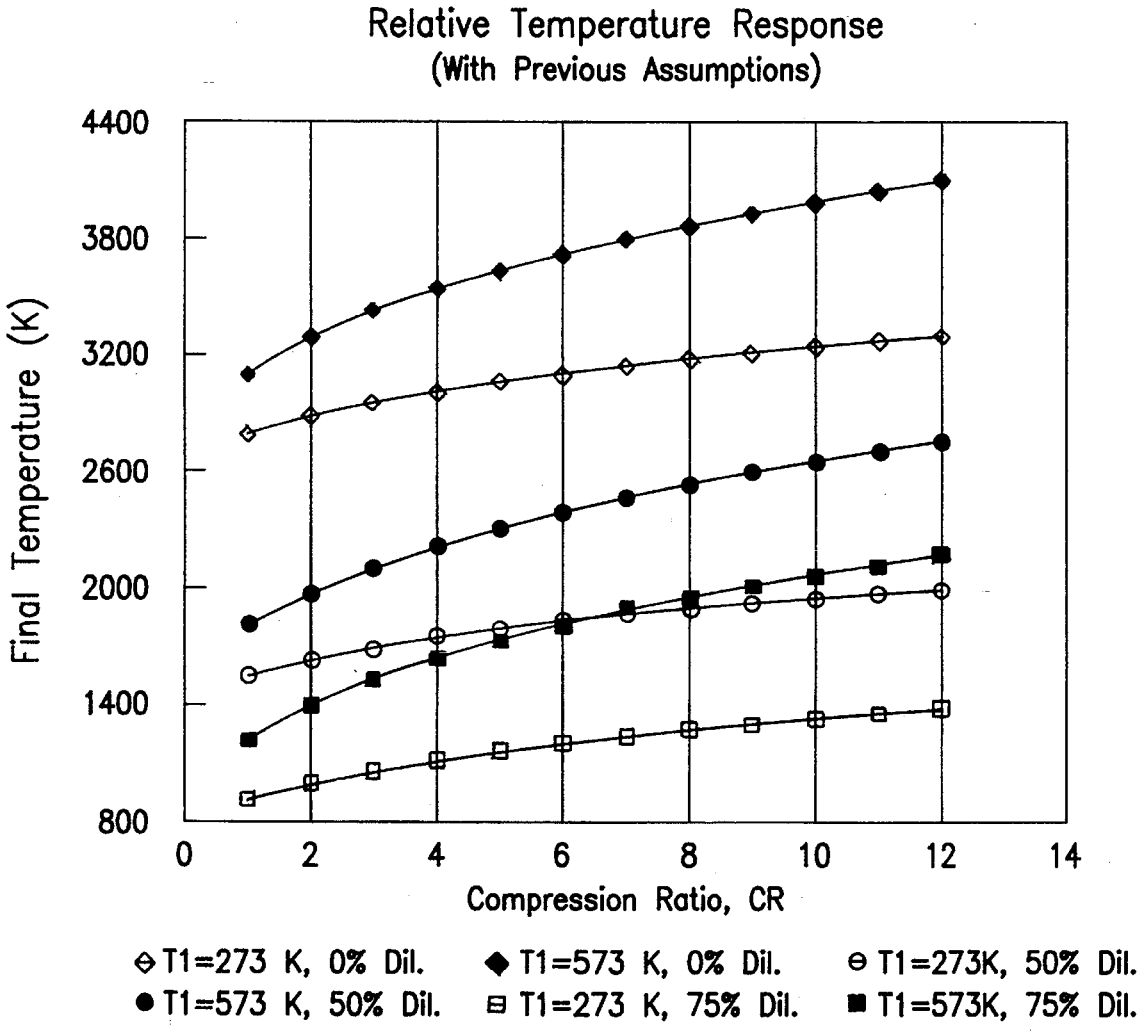
FIG. 2 is a graph of temperature versus compression ratio for various air and diluted (dil.) air gas feeds to the combustion gas chamber in the present invention.

FIG. 2 shows the relative temperature response to compression ratio, initial charge temperature and increased system mass, with the previous assumptions. Therefore, the specific embodiments of the method of this invention will utilize various combinations of: (1) increasing system mass for a given quantity of heat absorbed (usually utilizing various combinations of exhaust gas and excess air), (2) minimizing compression ratio and (3) minimizing the beginning system temperature.

Another consideration in the present invention is the means of providing lubrication of the piston rings, considering that the peak combustion chamber wall temperature may be as high as 800° C. , or higher. This is particularly significant in that conventional liquid lubricants may only allow operation up to around 250° C. Even 75% dilution (e.g. 50% "recycled" exhaust gas, 25% excess air and 25% stoichiometric air/fuel mixture), 0° C. initial charge temperature, and eight to one compression ratio, would yield an adiabatic peak combustion temperature of around 1300° K. (1027° C.). (See FIG. 2.) However, the cylinder wall peak temperature can also be minimized by combustion chamber design, combustion timing and other means.

Figure 3:
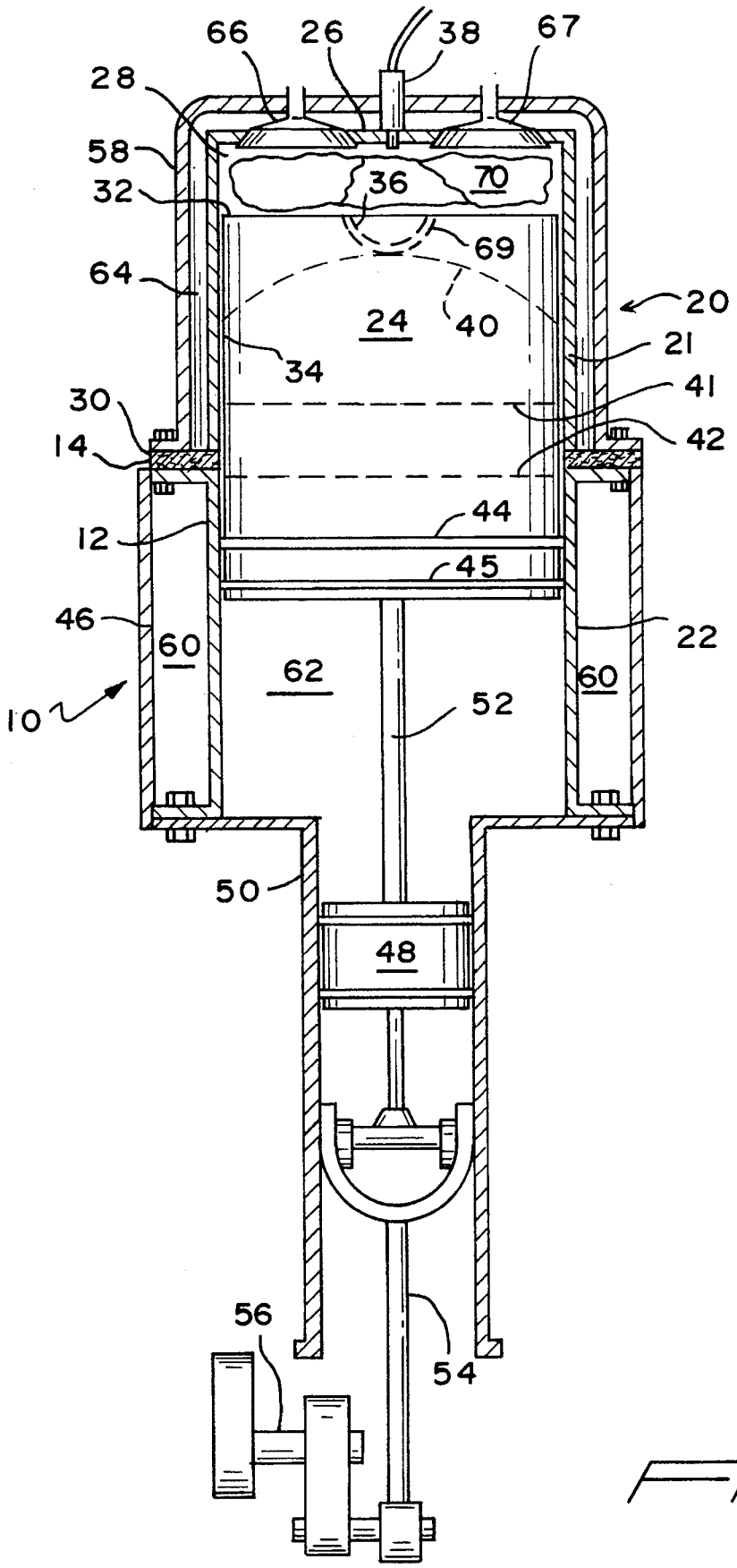
FIG. 3 is a elevational view, partially in cross-section, of a first embodiment of the apparatus of the present invention.

FIG. 3 illustrates an embodiment of the present invention which utilizes a four stroke cycle. The internal combustion engine (ICE), generally designated by the numeral 10, is shown as including a cylinder 20 divided into upper section 21 and lower section 22. Piston 24 is slidably mounted in the cylinder 20 for reciprocating motion between top dead center and bottom dead center. The upper end of the cylinder 20 is closed by a cylinder head 26 which, in cooperation with the piston 24 and upper cylinder section 21 defines a system chamber 28. The cylinder head contains an air intake valve 66 and an exhaust valve 67 which operate in the conventional manner.

A gasket of thermal insulating material 30 serves to form a thermal barrier between upper cylinder section 21 and lower cylinder section 22. The thermal insulating gasket may suitably be a mat of non-metallic ceramic fiber with or without a filler. Suitable gasket materials are marketed by the 3M Corporation under the tradename "INTERAM".

The piston 24 has a top surface portion, i.e., plate 32, and a skirt portion 34 which depends from the top portion 32. The top surface of plate 32 of piston 24 has a semispherical pocket 36 in the center thereof which receives the fuel from a fuel injector 38 centrally located, whereby the pocket 36 defines a zone of localized combustion. The top plate 32 and skirt 34 of the piston define a hollow interior of less mass as compared with the conventional ICE piston. A dome member 40 is provided within the hollow interior of piston 24 and is fixed to the bottom of the metal sheet of pocket 36 in order to provide structural reinforcement for the top plate 32 of the piston. The piston top plate 32, skirt 34, pocket 36 and dome 40 are all formed of a suitable heat resistant material having the requisite structural strength, for example, a titanium steel. The dome 40 also serves as a heat reflecting shield for reflecting heat back toward the top plate 32 of the piston. Two additional heat shields 41 and 42 also span the interior of the piston and serve to reflect heat back toward top plate 32. Like dome 40, heat shields 41 and 42 may be a sheet or membrane of titanium steel. As previously noted, it is contemplated that the present invention will operate with a peak gas pressure substantially lower than that of a conventional ICE. The reduced pressure allows the mass of the piston to be reduced, but reduced pressure translates to reduced work, unless the piston area is increased. Accordingly, the piston in the present invention will have a significantly larger diameter than a piston in a conventional ICE of like power capacity. For example, to produce the power output of a conventional small ICE having a 70–80 mm diameter bore, the piston of the present invention would have a diameter of approximately 150–250 mm.

The skirt 34 of piston 24 carries a plurality of oil rings shown as 44 and 45 in the drawings. The oil rings are located at the end of the skirt in an area most remote from top plate 32 and the length of the piston and location of the oil rings is such that the top plate 32 of the piston and oil rings 44 and 45 are on opposite sides of the thermal barrier defined by gasket 30 with the piston 24 at top dead center. The integrity of the lubrication of oil rings 44 and 45 (lubricated from the crank case in the conventional manner) can be further enhanced by circulation of a coolant in the conventional manner through the space defined between jacket 46 and lower cylinder 22.

As shown in FIG. 3, the piston 34 is mounted at one end of a piston rod 52 with the opposite end of piston rod 52 being connected to a guide piston 48 which is reciprocally mounted in a guide cylinder 50. The guide piston 48 is connected to a crank shaft 56 by a piston rod 54 whereby the reciprocating motion of pistons 24 and 48 is converted to a rotary output in the conventional manner. The combination of guide cylinder 50 and piston 48 is designed to prevent lateral forces from acting on the piston 24. Other guide mechanisms can be suitably employed for the same purpose, for example, sliders, roller bearings or a rhombic drive (the rhombic drive would also replace the crank shaft). However, in assorted configurations, it may be possible to dispense with the guide mechanism entirely. For example, adaption of the present invention to a two stroke cycle, as presently conceived, would not require a guide member as exemplified by 48 and 50 in the embodiment depicted in FIG. 3.

As noted above, the lower cylinder 22 may be cooled by circulation of engine coolant through space 60 in the conventional manner. The upper cylinder 21 is also provided with a surrounding jacket 58 defining a space 54 therebetween. Insulation may be provided by either air within space 64 or by provision of a suitable thermal insulating material in space 64. Space 62 is in communication with the bottom of piston 24 and air within this space also serves to cool the piston.

The semispherical pocket 36 is formed as a depression in the top plate or surface 32 of the piston and is lined with an insert of an insulating material 69. The insert 69 may suitably be a ceramic material.

In operation, during the intake stroke, the air and exhaust gas-diluted charge is introduced into system chamber 28 through intake valve 66 as the piston 24 travels from its top stroke position (top dead center) to its bottom stroke position (bottom dead center). Intake valve 66 closes as the piston 24 reaches its bottom stroke position. Compression occurs as the piston travels to its top stroke position. Fuel is injected through the fuel injector 38 and ignited by the compression temperature or by a spark plug, glow plug or other means (not shown). The increased pressure of the system is expanded and produces shaft power as the piston travels to its bottom stroke position. As the piston travels to its next top stroke position the exhaust valve 67 has opened to allow discharge of the expanded gases. The cycle then repeats.

Peak combustion temperature is controlled primarily through system dilution with exhaust gas and/or excess air as previously described. However, much of the heat energy that will still be lost will pass through the wall of upper cylinder 21, even though the insulation in space 64 will reduce the heat loss substantially. Therefore, further minimizing the system chamber wall temperature is beneficial and is achieved by localizing combustion within pocket 36 near the center of the piston top plate 32 so that a toroidal ring 70 of exhaust gas and air between the pocket 36 (effectively the combustion chamber) and the wall of cylinder 21 serves as thermal insulation. Further benefits are gained by locating the combustion chamber in a compact column within the piston (or alternately in a recessed chamber near the center of the head 26 between the valves). This allows a high temperature insulating insert 69 to be installed in the piston. The piston insert 69 reduces conductive heat transfer directly to the piston, and its location within the piston reduces radiant heat transfer to the cooler system chamber walls by shielding the walls from the highest temperature gases.

Figure 4:
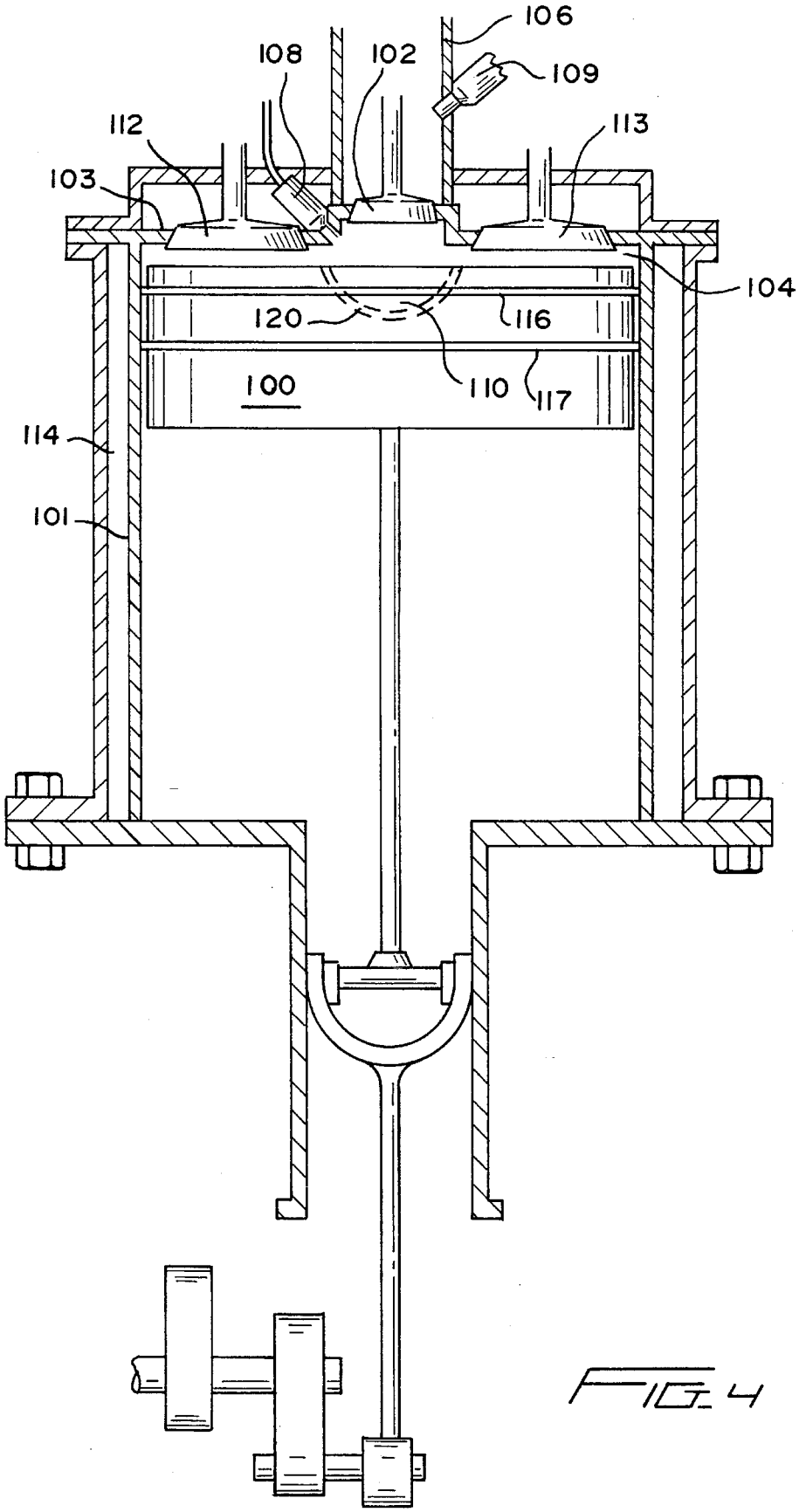
FIG. 4 is an elevational view, partially in cross-section, of a second embodiment of the apparatus of the present invention.

A second embodiment of the present invention, utilizing a two stroke cycle is shown in FIG. 4. In operation, near the top stoke position of piston 100 (after the exhaust/compression stroke which occurs as the piston travels from its bottom stroke position to the top stroke position), pressurized air (which can be supplied by a variety of means, including an engine driven piston compressor) is injected through an air valve 102 into the combustion chamber 110 as air valve 102 opens. Air flows through air supply duct 106 into the chamber 110. Air valve 102 is shut after sufficient air is supplied with the piston 100 still near its top stroke position. Fuel is then injected into the air within the combustion chamber 110 through fuel injector 108 and ignited by the compression temperature or by a spark plug, glow plug or other means (not shown). Alternatively, a fuel injector 109 mounted in air duct 106 may be employed. The increased pressure of the system is expanded and produces shaft power as the piston travels to its bottom stroke position. As the piston begins its travel from the bottom stoke position to the top stroke position, exhaust valves 112 and 113 open. (One or more exhaust valves may be used.) Expanded system gases are discharged through the exhaust valves 112 and 113 until the exhaust valves close, for example, near the mid-point of the piston travel toward its top stroke position. The remaining system gases are then compressed as the piston 100 completes its travel to the top stroke position (i.e., the exhaust/compression stroke). The cycle then repeats.

Peak combustion temperature is again controlled primarily through system dilution with exhaust gas (through mixing) and/or excess air as previously described. However, this embodiment provides a concentration of air within the combustion chamber 110, with primarily spent system gases remaining from the previous cycle contained within the remaining volume of the system chamber 104. This separation (or stratification) of the air mixture from the remaining spent system gases allows much greater overall system dilution and therefore lower temperatures, yet still allows good combustion within the air-concentrated mixture.

The second embodiment may also contain several features of the first embodiment including: system chamber insulation 114, a center or near-center compact combustion chamber location (for example 110, within the piston), and high temperature combustion chamber insulating insert 120.

Since the second embodiment allows much higher overall system dilution, and in particular, the outer ring of gases being composed primarily of remaining spent system gases, system chamber walls 101 and 103 can be maintained at lower temperatures such that high temperature liquid lubricants can be used to lubricate the piston rings 116 and 117. Certain piston ring and system chamber wall materials may also be utilized, if sufficient durability is attained, without liquid lubrication. In this embodiment side forces on the piston 100 are substantially reduced and therefore the guiding mechanism (48, 50 in the first embodiment) may be deleted.

The second embodiment provides higher specific power than the first, but requires a separate pressurized air supply system.

The second embodiment allows a greater expansion ratio than compression ratio by adjusting the quantity of remaining spent system gases and the quantity of injected air. This feature provides a lower system pressure and temperature at the end of expansion (and thus improves thermodynamic efficiency as discussed previously). A lower temperature for the remaining spent system gases also reduces the temperature of the system chamber walls.

Other embodiments of the invention flow logically from the two specific designs described. For example, the first embodiment described may retain a more conventional piston design with the piston rings near the top of the piston (e.g., as described in the second embodiment) while still incorporating air insulation and radiant heat shields. However, rings in the top of the piston will need to be dry lubricated or the system chamber walls will need to be cooled sufficiently to allow use of high temperature liquid lubricant. Compromises which allow simpler, lower cost designs but result in increased heat loss will need to be subjected to a cost benefit analysis, i.e., do the cost savings justify the efficiency loss The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

I claim:

1. An internal combustion engine comprising:

a cylinder;

a head closing one end of said cylinder;

a piston slidably mounted in said cylinder, for reciprocating motion between top dead center and bottom dead center, said piston having a top surface facing said head, and a cylindrical skirt depending from said top surface and defining a hollow piston interior, said piston top surface, said head and a first section of said cylinder serving as walls defining a system chamber;

cylinder thermal insulation means, surrounding said first section of said cylinder, for preventing heat loss from said system chamber;

a pocket located in a wall of said system chamber for receiving fuel and serving as a combustion chamber for localized combustion therein;

piston thermal insulation means, at least coextensive with said pocket, for preventing heat loss from said system chamber;

means for converting the reciprocating motion of said piston into a rotary output;

valve means in said head for introducing air into system chamber and for exhausting products of combustion from said system chamber; and fuel injection means for injecting fuel into said pocket.

2. An internal combustion engine in accordance with claim 1 wherein said pocket is centrally located in the top surface of said piston.

3. An internal combustion engine in accordance with claim 1 wherein said pocket is semispherical in cross-section.

4. An internal combustion engine in accordance with claim 1 wherein said first section of said cylinder is axially spaced and separated from a second section of said cylinder by a thermal insulation barrier.

5. An internal combustion engine in accordance with claim 4 further comprising oil rings mounted in grooves on said skirt of said piston, said oil rings being spring biased outward into sealing engagement with said cylinder, the distance between said top surface and the oil ring closest to said top surface being greater than the distance between said thermal insulation barrier and top dead center.

6. An internal combustion engine in accordance with claim 5 additionally comprising at least one heat shield supported by said skirt and spanning said hollow interior for reflecting heat from said combustion chamber back toward said top surface, said one heat shield located between said top surface and said oil rings.

7. An internal combustion engine in accordance with claim 6 wherein said one heat shield is a planar metal sheet.

8. An internal combustion engine in accordance with claim 1 additionally comprising at least one heat shield membrane supported by said skirt and spanning hollow interior for reflecting heat from said combustion chamber back toward said top surface.

9. An internal combustion engine in accordance with claim 8 wherein said one heat shield membrane is a planar metal sheet.

10. An internal combustion engine in accordance with claim 2 additionally comprising a dome internal of said piston, said dome being supported by said skirt and extending to a peak fixed to the bottom of said pocket for structurally supporting said top surface and for reflecting heat from said combustion chamber back toward said top surface.

11. A method for conducting combustion at near adiabatic conditions in a combustion chamber, said combustion chamber formed by a cylinder, a head closing one end of the cylinder and having an exhaust valve and an air intake valve therein and a piston slidably mounted in the cylinder for reciprocating motion therein, said method comprising:

introducing air through said air intake valve into the combustion chamber in an amount providing a peak, average gas temperature, resulting from said localized combustion, of 900°–1100° C.;

injecting fuel into a restricted area within said combustion chamber for localized combustion within said restricted area, with air within the combustion chamber surrounding said restricted area serving to thermally insulate said cylinder from said localized combustion; and exhausting products of said localized combustion from said combustion chamber through said exhaust valve.

12. A method in accordance with claim 11 wherein said restricted area is defined by a pocket in a top surface of said piston.

13. A method in accordance with claim 12 wherein said pocket is semispherical in cross-section.

14. A method in accordance with claim 11 wherein said air is introduced into the combustion chamber in an amount providing 4 to 5 times the stoichiometric amount of oxygen.

15. A method in accordance with claim 14 wherein the peak, average gas temperature resulting from said localized combustion is 900°–1100° C.

16. A method in accordance with claim 11 wherein the peak pressure within the combustion chamber is 500–1000 psi.

17. A method in accordance with claim 15 wherein the peak pressure within the combustion chamber is 500–1000 psi.

18. A method in accordance with claim 11 wherein air is injected into said pocket to provide an air-concentrated mixture for said localized combustion.

19. A method in accordance with claim 11:

wherein said exhausting through said exhaust valve occurs during piston movement from bottom dead center to a mid-point approximately one-half the distance between bottom dead center and top dead center;

wherein when said piston reaches said mid-point, said exhaust valve closes, said air intake valve opens and air from a separate pressurizing means enters said chamber through the open air intake valve;

wherein further piston movement to top dead center compresses air and remaining spent gases while, with said air intake valve closed, fuel is injected and combustion occurs; and whereby piston movement during expansion from top dead center to bottom dead center provides a larger expansion ratio than compression ratio, with the increase depending on the pressure of the introduced air.

20. An internal combustion engine in accordance with claim 4 further comprising cooling means for cooling said second section of said cylinder.

21. An internal combustion engine in accordance with claim 1 wherein said cylinder thermal insulation means comprises a jacket spaced from said cylinder to define an air gap therebetween.

22. An internal combustion engine in accordance with claim 20 wherein said air gap contains a thermal insulating material.

* * * * *